US007886397B2

(12) United States Patent
Gueret

(10) Patent No.: US 7,886,397 B2
(45) Date of Patent: Feb. 15, 2011

(54) APPLICATOR AND APPLICATION DEVICE INCLUDING THE APPLICATOR

(75) Inventor: Jean-Louis H. Gueret, Paris (FR)

(73) Assignee: L'Oreal S.A., Paris (FR)

( * ) Notice: Subject to any disclaimer, the term of this patent is extended or adjusted under 35 U.S.C. 154(b) by 1860 days.

(21) Appl. No.: 10/790,179

(22) Filed: Mar. 2, 2004

(65) Prior Publication Data

US 2004/0226573 A1 Nov. 18, 2004

Related U.S. Application Data

(60) Provisional application No. 60/463,050, filed on Apr. 16, 2003.

(30) Foreign Application Priority Data

Mar. 3, 2003 (FR) ..... 03 02546

(51) Int. Cl.
*A46B 9/02* (2006.01)
*A45D 40/26* (2006.01)

(52) U.S. Cl. ..... 15/160; 132/218

(58) Field of Classification Search ..... 15/160; 132/218; 401/126, 129; 300/21
See application file for complete search history.

(56) References Cited

U.S. PATENT DOCUMENTS 3,343,551 A 9/1967 Anderson
3,921,650 A 11/1975 Montgomery
4,214,340 A * 7/1980 Youngberg et al. ..... 15/184
4,403,624 A 9/1983 Montgomery
4,804,004 A 2/1989 Taylor
4,893,876 A * 1/1990 Weihrauch ..... 300/8
4,964,429 A 10/1990 Cole
5,622,502 A * 4/1997 Wilkes et al. ..... 433/216
5,761,760 A * 6/1998 Dumler et al. ..... 15/206
6,033,143 A * 3/2000 Gueret ..... 401/129
6,253,404 B1 * 7/2001 Boland et al. ..... 15/22.1
6,341,912 B1 * 1/2002 Gueret ..... 401/129
6,773,076 B1 * 8/2004 Weihrauch ..... 300/21
6,810,550 B1 * 11/2004 Wuelknitz et al. ..... 15/167.1
6,810,885 B2 * 11/2004 Montoli et al. ..... 132/218
7,156,105 B2 * 1/2007 Gueret ..... 132/218
2002/0011251 A1 1/2002 Gueret
2002/0023658 A1 * 2/2002 Gueret ..... 132/218
2003/0230317 A1 * 12/2003 Montoli et al. ..... 132/218
2004/0112400 A1 * 6/2004 Kurek ..... 132/218

(Continued)

FOREIGN PATENT DOCUMENTS

DE 19949772 A1 * 3/2001

(Continued)

*Primary Examiner*—David B Thomas
(74) *Attorney, Agent, or Firm*—Finnegan, Henderson, Farabow, Garrett & Dunner LLP

(57) ABSTRACT

An applicator for applying a cosmetic product includes a support comprised of plastic material and at least one bundle of bristles associated with the support. In some examples, the bundle may include an end portion defining a first row of bristles extending substantially in a longitudinal direction of the support, and the bundle may being split into at least two sub-bundles extending away from the end portion. The at least two-sub bundles may define second and third rows of bristles extending at least in part outside of the support.

66 Claims, 4 Drawing Sheets

U.S. PATENT DOCUMENTS

| | | | | |
|---|---|---|---|---|
| 2005/0040693 | A1 * | 2/2005 | Montoli et al. | 300/21 |
| 2005/0285439 | A1 * | 12/2005 | Kubaitis | 300/21 |

FOREIGN PATENT DOCUMENTS

| | | | |
|---|---|---|---|
| EP | 0 237 360 | | 9/1987 |
| EP | 458496 | A1 * | 11/1991 |
| EP | 610107 | A1 * | 8/1994 |
| EP | 1 155 637 | | 11/2001 |
| FR | 1 210 939 | | 3/1960 |
| JP | 62-58515 | | 4/1987 |
| WO | WO 9207487 | A1 * | 5/1992 |
| WO | WO 9619930 | A1 * | 7/1996 |

* cited by examiner

APPLICATOR AND APPLICATION DEVICE INCLUDING THE APPLICATOR

This application claims the benefit of priority under 35 U.S.C. § 119(e) of U.S. provisional application No. 60/463,050, filed on Apr. 16, 2003, which is incorporated herein by reference; additionally this application claims the benefit of priority of French Application No. 03 02546, filed on Mar. 3, 2003.

BACKGROUND

1. Field of the Invention

The present invention relates to applicators for cosmetics, including care products. More particularly, the present invention relates to applicators for applying a substance to keratinous fibers, such as the eyelashes and/or the eyebrows.

2. Description of the Related Art

Conventional brushes used for making up the eyelashes and/or the eyebrows comprise a metal core having two strands twisted together to clamp bristles therebetween. Such brushes are usually not suitable for being used in a technique where a brush, loaded with a substance to be applied, is heated in a microwave oven to modify properties of the substance, e.g. prior to application. In addition, with certain compositions, the bristles are too floppy to be suitable for smoothing the substance on the eyelashes.

It is also known to use molded-plastic combs for making up the eyelashes or the eyebrows. The plastic material makes such combs suitable for being heated in a microwave oven. In addition, some combs can be made with teeth that are stiffer than bristles of a brush, thus making it possible to use different formulations. Nevertheless, the lack of flexibility of the teeth can sometimes lead to a lack of comfort during substance application.

For these and other reasons, there is a need for alternative approaches. For example, it would be desirable to have an applicator including a non-metallic support and bristles associated with the support.

SUMMARY OF THE INVENTION

In the following description, certain aspects and embodiments of the present invention will become evident. It should be understood that the invention, in its broadest sense, could be practiced without having one or more features of these aspects and embodiments. In other words, these aspects and embodiments are merely exemplary.

At least some aspects of the invention may generally relate to an applicator for applying a cosmetic product. In some examples, the applicator may be configured to apply a cosmetic product to keratinous fibers, such as the eyelashes and/or the eyebrows, for example.

In one aspect, the applicator may comprise an applicator element including a support comprised of plastics material and at least one bundle of bristles associated with the support.

In at least some embodiments, the bundle may comprise an end portion defining a first row of bristles extending substantially in a longitudinal direction of the support. The bundle may be split (e.g., going away from the end portion) into at least two sub-bundles extending away from the end portion of the bundle. The at least two sub-bundles may define second and third rows of bristles extending at least in part outside of the support.

For at least some embodiments, the support may define a plurality of openings, and the at least one bundle may be split into at least a first sub-bundle comprising bristles passing through at least one of the openings and extending away from the support, and a second sub-bundle comprising bristles passing through at least one other of the openings and extending away from the support, wherein the first sub-bundle and the second sub-bundle may extend away from an end portion of the bundle.

In some examples, the first row of bristles (and/or the end portion) may have a number of bristles that is substantially equal to the total number of bristles in the second and third rows (and/or in the first and second sub-bundles). Optionally, the second and third rows of bristles (and/or the first and second sub-bundles) may have substantially the same number of bristles.

In another aspect, the first row of bristles (and/or the end portion) may extend at least in part outside of the support. In one other aspect, the first row of bristles (and/or the end portion) may not project outside of the support.

In a further aspect, the second and third rows of bristles (and/or the first and second sub-bundles) may comprise respective successions of tufts leaving the support through respective distinct openings.

In yet another aspect, the first row (and/or end portion) may comprise a substantially continuous sheet of bristles and/or a succession of tufts leaving the support via distinct openings.

For some embodiments, a tuft of bristles may be constituted by, for example, two to 200 bristles, four to 100 bristles, or five to 50 bristles.

In still another aspect, to form the second and third rows (and/or the first and second sub-bundles), the bundle of bristles may be split inside the support or outside it.

In an even further aspect, the second and third rows of bristles (and/or the first and second sub-bundles) may extend from one side of the support relative to a separation plane containing the longitudinal axis of the support (e.g., a plane perpendicular to the midplane) and the first row (and/or end portion) may extend from an opposite side of the support relative to the separation plane.

For some embodiments, the bristles may be held to the support by overmolding the support material on the bristles. Alternatively, the bristles may be held without the use of overmolding. For example, the bristles may be held to the support by local melting of support material.

In another aspect, the bristles may be made out of a material that is identical to or different from the material constituting the support.

The support may be made in a variety of shapes. In some examples, the support may include at least one row of teeth. For example, the teeth may be made out of the same material as the remainder of the support, or alternatively they may be made out of some other material, e.g. by molding with dual injection of material. In some examples, the teeth may be made out of a material that is more flexible than the material constituting the portion of the support that carries the bristles. Some embodiments including teeth may have the teeth disposed in at least one row extending between two rows of bristles, for example, between the second and third rows.

In yet a further aspect, in a plane perpendicular to the longitudinal axis of the support, the major dimension of the support may be less than or equal to 5 millimeters (mm), for example.

In some examples, each of the second and third rows of bristles (and/or the first and second sub-bundles) may comprise one or more tufts of bristles (e.g., one tuft or a sucession of tufts). For certain embodiments, the tufts of bristles in the second row (and/or in the first sub-bundle) may be disposed substantially at the same level as the tufts of bristles in the third row (and/or in the second sub-bundle), along the longitudinal axis of the support.

In at least a few embodiments, the tufts of bristles in the second row (and/or in the first sub-bundle) may be axially offset relative to the tufts of bristles in the third row (and/or in the second sub-bundle). For example. the applicator may then comprise a succession of tufts of bristles extending in alternation along two diverging directions.

In another aspect, the support may include openings situated respectively in two opposite faces of the support or in the same face of the support. For example, the openings may be in alignment or disposed in a staggered configuration. Optionally, each of the sub-bundles may define at least one tuft of bristles exiting the support via a respective one of the openings.

There are many different possible shapes for the axis of the support. In some examples, the longitudinal axis of the support may be rectilinear. Alternatively, the axis of the support may be curvilinear, for example, substantially in the form of a portion of a circular arc matching the radius of the eyelids at the roots of the eyelashes.

In some embodiments, the apparent length of bristles in at least one of the rows (and/or in at least one of the sub-bundles) may vary along the longitudinal axis of the support. For example, the apparent length may vary continuously, passing through a single extremum, e.g. a maximum or a minimum, or it may vary periodically so that an envelope surface defined by the free ends of the bristles presents undulations along the longitudinal axis of the support when the support is observed from the side.

As mentioned above, some embodiments may include openings through which the bristles pass and leave the support. In some examples, the openings may comprise axes that are perpendicular to the longitudinal axis of the support. Alternatively, the openings may comprise axes that are directed obliquely relative to the longitudinal axis of the support, e.g. in alternation towards its distal end and towards its proximal end, such that the bristles cross when the support is observed from the side.

In yet a further aspect, the plastic material of the support may be a rigid material, a semi-rigid material, and/or an elastomer.

In still another aspect, the applicator may comprise at least three rows of bristles and a support carrying the bristles, the support being overmolded thereon.

For some embodiments, the end portion of the bundle may be defined by at least substantially all of the bristles of the bundle (e.g., the end portion may include at least substantially all of the bristles that define the sub-bundles). All of the bristles of the end portion may be substantially parallel to one another along at least part of the end portion (e.g., when the end portion extends through a passage in the support). An end of the end portion may be defined by tip ends of the bristles. In some examples, each bristle may have one tip end at or near an end of the end portion and an opposite tip end at or near an end of a respective one of the sub-bundles. In embodiments where the end portion extends from the support, the end portion may define a bristle tuft and/or a sheet of bristles. Optionally, such a tuft and/or sheet may define a row of bristles.

In certain embodiments, forming a plurality bristle rows by splitting a bundle of bristles may make it easier to manufacture an applicator industrially at low cost, for example, by overmolding the support material on the bristles.

According to at some embodiments, the applicator may be simple and comfortable to use, enabling substance to be well spread on the fibers that are to be treated, with the fibers being lengthened (possibly to a significant extent) and curled.

In some embodiments (e.g., those made of non-metallic material), the applicator element may possibly be used in a technique involving a microwave oven for heating the substance for application, while still presenting at least some qualities of a mascara brush, e.g., in terms of comfort in application.

For some examples, the applicator may include bristles that have been fitted thereto, i.e. bristles that are made separately, upstream from the process of manufacturing the remainder applicator, and then implanted in a portion of the applicator during manufacture of the support or after the support has been manufactured.

Another aspect may include an application device (e.g., a packaging and application device) including an applicator as described herein. The device optionally may include a cosmetic product, e.g., a cosmetic product for application to eyelashes and/or eyebrows. One exemplary product is mascara or any other form of eyelash or eyebrow makeup.

In some examples, the device may include a receptacle for containing the substance to be applied. Optionally, the device may include a wiper member for wiping the applicator element as it is removed from the receptacle. The applicator element may be at one end of a stem (e.g., fitted to the stem). A handle member may be at another end of the stem (e.g., secured to the stem). The handle member may be a cap for closing the receptacle.

Aside from the structural arrangements set forth above, the invention could include a number of other arrangements such as those explained hereinafter. It is to be understood that both the foregoing description and the following description are exemplary only.

BRIEF DESCRIPTION OF THE DRAWINGS

The accompanying drawings are incorporated in and constitute a part of this specification. The drawings illustrate exemplary embodiments and, together with the description, serve to explain some principles of the invention. In the drawings.

DETAILED DESCRIPTION OF SOME EMBODIMENTS

Figure 1:
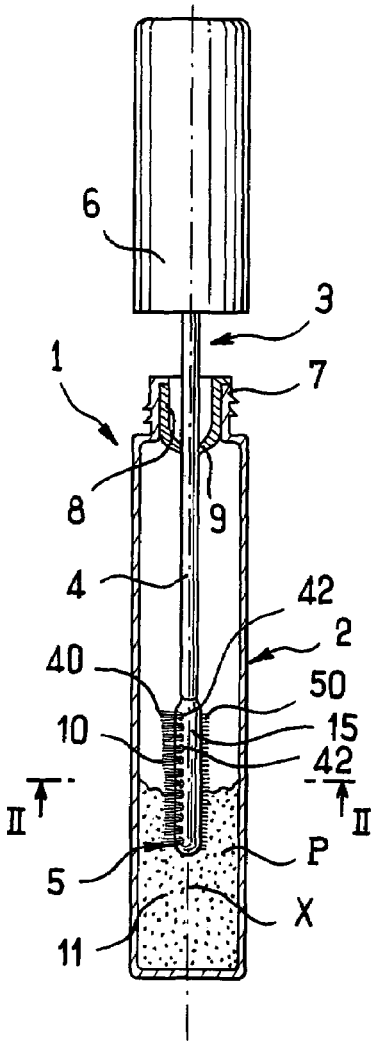
FIG. 1 is a diagrammatic partial cross-section view of an embodiment of an application device in accordance with the invention.

Reference will now be made in detail to a few exemplary embodiments of the invention. Wherever possible, the same reference numbers are used in the drawings and the description to refer to the same or like parts.

FIG. 1 shows an application device 1 (e.g., packaging and application device) that comprises a receptacle 2 containing a substance P for application to the eyelashes and/or the eyebrows, e.g. mascara, and an applicator 3. The applicator 3 comprises a stem 4 provided at its bottom end with an applicator element 5 and at its opposite end with a handle member 6 that also serves to close the receptacle 2. The receptacle has a neck 7 with an outside thread so as to enable the handle member 6 to be screwed thereon.

The substance P may be intended to color the eyelashes, and/or to lengthen them, and/or to curl them. The substance P may also (or alternatively) have a treatment effect.

A wiper member 8 is fixed inside the neck 6 to wipe the stem 4 and the applicator element 5 as they leave the receptacle. The wiper member 8 comprises, for example, a flexible lip 9 defining a circular opening having a diameter corresponding substantially to the diameter of the stem 4.

The applicator could be used with wiper members other than the shown in FIG. 1. For example, such other wiper members may comprise a block of foam and/or define one or more optionally-flocked slots. Alternatively, the applicator could be used without being associated with a wiper member.

In the example shown in FIG. 1, the stem 4 is rectilinear. Alternatively, the stem could be curved.

The stem 4 is fixed relative to the handle member 6. Alternatively, the stem may be movable relative to the handle member, for example by means of an articulated connection, such as a ball-and-socket joint.

The applicator element 5 comprises a support 15 made of plastic material. The stem is elongate along a longitudinal axis X, which, in the example shown in FIG. 1, is rectilinear and coincides with the longitudinal axis of the stem 4.

Figure 2:
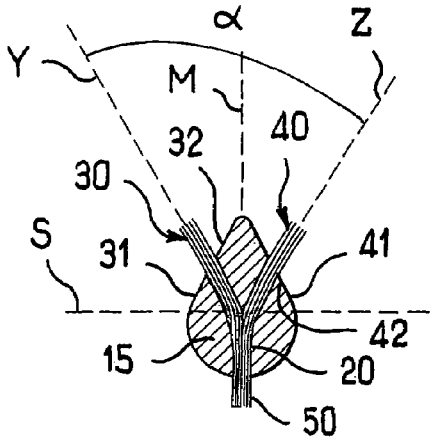
FIG. 2 is a diagrammatic and fragmentary cross-section view taken in a plane defined by line II-II in FIG. 1.

As shown in the exemplary embodiment of FIGS. 1 and 2, the support 15 carries a bundle 20 of bristles having an end portion emerging from one side of the support 15 and defining a first row 50. The bundle 20 is split into two sub-bundle portions that emerge from the opposite side of the support 15 and define second and third rows 30 and 40.

In the example shown in FIGS. 1 and 2, the support 15 is overmolded onto the bundle 20 of bristles. Alternatively, the support 15 may be made separately and then the bristles may be put into place therein and assembled to the support 15, e.g. by locally melting material.

As shown in FIG. 2, the rows 30 and 40 open out via openings situated respectively in two opposite faces 31 and 41 of the support 15. The rows 30 and 40 shown in FIG. 2 lie on the same side of a separation plane S containing the axis X, while the first row 10 is situated on the opposite side thereof.

Each of the rows 30, 40 of bristles may extend from the support 15 via a single opening of oblong shape elongate parallel to the axis X (e.g., a single opening may be provided for the row 30 and another single opening may be provided for the row 40), or as is the case in FIG. 2, via a succession of respective openings 32 and 42 each enabling a tuft of bristles to emerge.

The number of bristles in each row 30, 40 shown in FIG. 2 corresponds to approximately half the number of bristles in the row 50. Alternatively, the applicator element may be made differently. For example, one of the rows 30 and 40 may have significantly more bristles than the other row, in other words the bundle of bristles could be split in a ratio other than 50/50.

Figure 3:
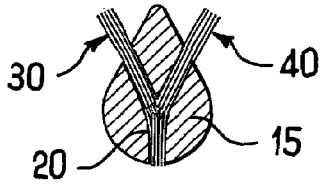
FIG. 3 is a view analogous to that of FIG. 2 showing an alternative embodiment.

In the example shown in FIG. 2, the bristles of the first row 50 are of non-zero length. Alternatively, as shown in FIG. 3, the bristles of the row 50 may have substantially zero length, wherein the bristles of this row 50 are shaved off after the support 15 has been molded, for example. In some further alternative arrangements, the bristles of the first row 50 may not even extend as far as the outside surface of the support.

The support 15 may be made with a shape different from that shown in FIGS. 1 and 2. For example, the support may have at least one row of teeth 60 extending between the rows 30 and 40 of bristles, as shown in FIGS. 4 and 5.

Figure 4:
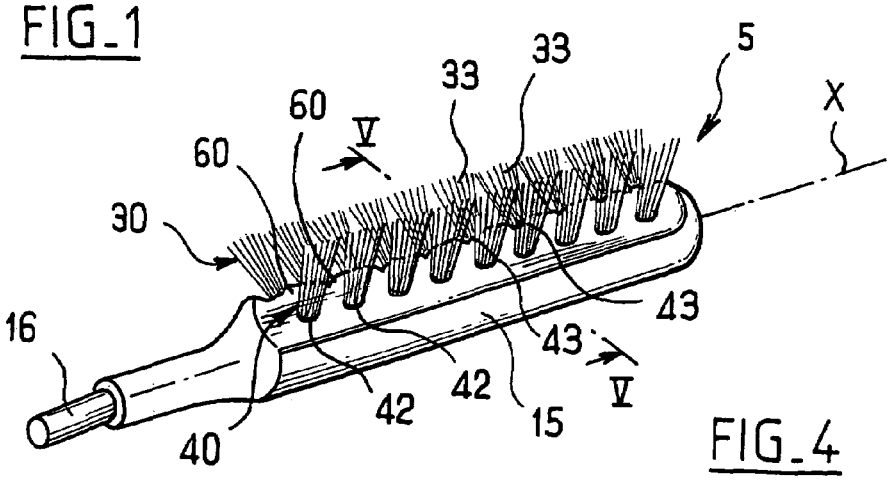
FIG. 4 is a diagrammatic perspective view showing in isolation an applicator element in accordance with another variant embodiment.

FIG. 4 shows that the support 15 may be made with an endpiece 16 at one end for insertion in the stem 4. Alternatively, the applicator element, regardless of its shape and how the bristles are implanted, may be made integrally with the stem 4 by molding material.

Figure 5:
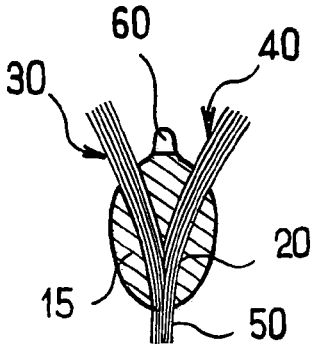
FIG. 5 is a cross-section view taken in a plane defined by line V-V of FIG. 4.

The bundle of bristles 20 may be split inside the support as shown in FIGS. 2, 3, and 5. Alternatively, the bundle of bristles may be split outside the support 15, e.g. close to its outside surface, as shown in FIG. 6.

Figure 6:
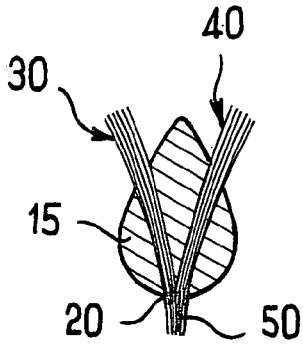
FIGS. 6 to 10 are views analogous to FIG. 2, showing other variant embodiments.
Figure 7:
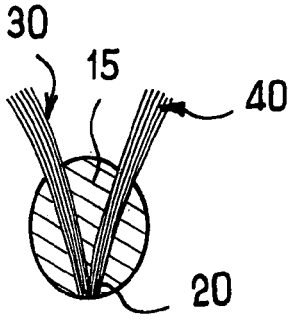

The example of FIG. 7 differs from that of FIG. 6 in that the length of the bristles in the first row 50 is substantially zero.

As exemplified by FIG. 7, the support may present a variety of shapes in cross-section other than those shown in FIGS. 2 and 3. FIG. 7 illustrates how the support may present a section that is substantially circular, for example.

Figure 8:
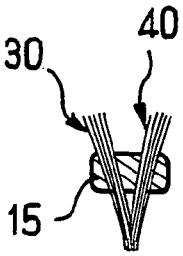

In the example of FIG. 8, the bristles of the rows 30 and 40 meet outside the body 15.

As shown in FIG. 2, the rows 30 and 40 may extend in diverging planes Y and Z, wherein the planes may be parallel to the longitudinal axis X when the axis is rectilinear. FIG. 2 shows an example of how the planes Y and Z may be symmetrical about a midplane M of symmetry for the support 15. The axis X may be contained in said midplane M.

Figure 9:
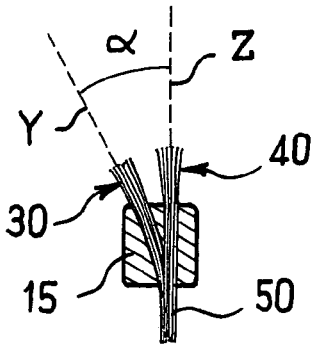

Alternatively, the planes Y and Z may not be disposed symmetrically about the midplane M of the support 15, as shown in FIG. 9.

The angle $\alpha$ between the planes Y and Z may lie in the range 3° to 90°, for example, and may be close to 40°, for example.

In the examples shown in FIGS. 1-9, the applicator element 5 has three rows 30, 40, and 50 of bristles. Alternatively, the applicator element may have more than three rows of bristles, for example four rows of bristles. (In some alternative arrangements, the bristles of the end portion and/or sub-bundles may define less than three rows or possibly no rows at all.)

Figure 10:
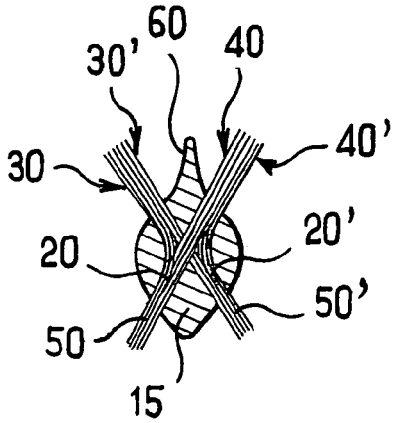

By way of example, FIG. 10 shows an applicator element comprising two bundles 20 and 20' of bristles which are split so as to form two rows 30 and 40 for the bundle 20 and two rows 30' and 40' for the bundle 20'. The rows 30 and 30' may be united within a single sheet, and the rows 40 and 40' may be united within a single sheet, as shown. Optionally, the support 15 may include a row of teeth 60.

The rows of bristles 30, 40, and 50 may be grouped together in tufts or they may extend in substantially continuous sheets.

When the bristles of the rows 30 and 40 are grouped together in tufts, each tuft 33, 43 of one of the rows 30, 40 may be situated at substantially the same level along the axis X as a tuft in the other row, i.e. without any offset along the axis X, as shown in FIG. 4.

Figure 11:
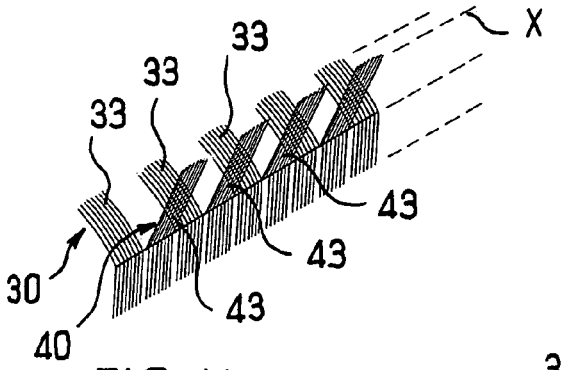
FIGS. 11 and 12 are diagrammatic views showing various ways, amongst others, for splitting the bundle of bristles.
Figure 12:
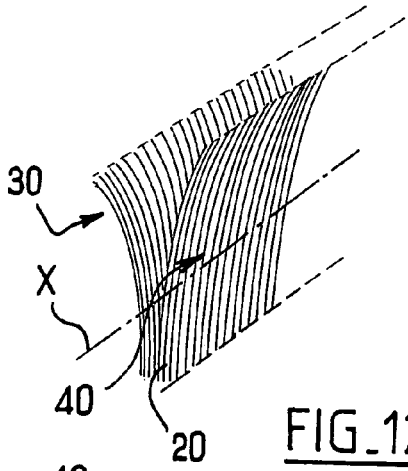

The tufts 33 and 43 may also be offset along the axis X, as shown in FIG. 11. In this figure, the support 15 is not shown. In a variant, as shown in FIG. 12, the bristles of the rows 30 and 40 may extend in the form of sheets that are substantially continuous along the axis X.

Figure 13:
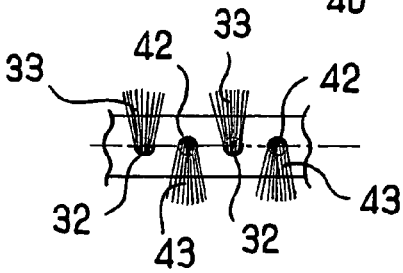
FIG. 13 is a fragmentary diagrammatic plan view of an applicator element in accordance with another variant embodiment.

Optionally, the tufts 33 and 43 may extend through openings 32 and 42 that are substantially in alignment, as shown in FIG. 13, the axes of these openings being perpendicular to the axis X, for example.

The bristles of the rows 30 and 40 may extend substantially perpendicularly to the longitudinal axis X.

Figure 14:
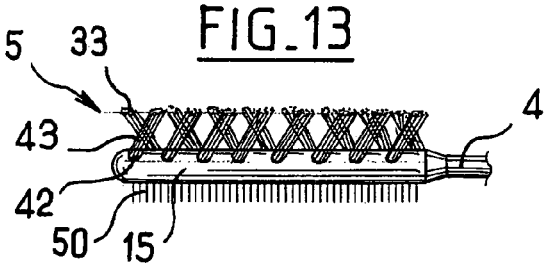
FIGS. 14 to 18 are fragmentary diagrammatic side views showing other applicators embodiments.

In a variant, as shown in FIG. 14, the tufts of bristles 33 and 43 and the axes of the corresponding openings 32 and 42 may be inclined respectively towards the proximal end of the applicator element 5 and towards its distal end, such that when the applicator element is observed from the side, the tufts of bristles 33 and 43 cross.

It is possible to give the envelope surface defined by the free ends of the bristles of the applicator element 5 a variety of shapes, for example, as a function of the zone to be treated and of the effect that it is desired to obtain.

Figure 15:
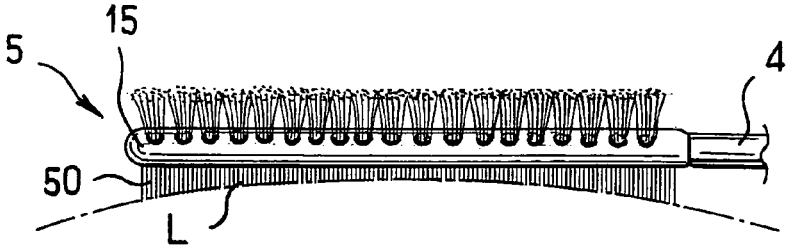

By way of example, the bristles of the applicator element 5 may be machined in such a manner that the ends of the bristles of the row 50 extend along a line L that is outwardly concave when the applicator element is observed from the side, as shown in FIG. 15. For example, the curvature of the line L may correspond substantially to that of an eyelid.

Figure 16:
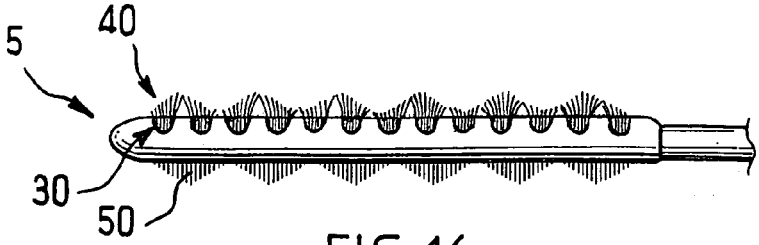

It is also possible, as shown in FIG. 16, to machine the rows of bristles which extend outside the brush in such a manner as to form undulations, e.g. in order to comb the eyelashes or the eyebrows better.

Figure 17:
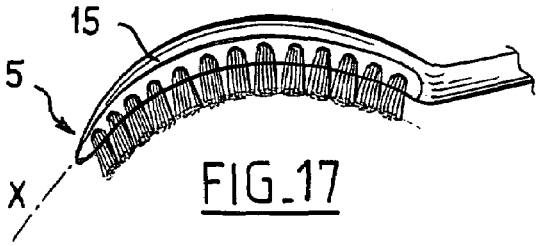

The support 15 may have a longitudinal axis X that is not rectilinear. For example, the axis that may be curvilinear, as shown in FIG. 17, and the bristles of the rows 30 and 40 may leave a concave or convex face of the applicator element 5, for example.

Figure 18:
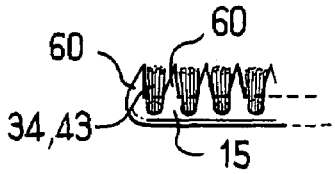

When the support 15 includes teeth, the teeth may alternate along the axis X with the tufts of bristles 33 and 43, as shown in FIG. 18.

All kinds of bristle may be used. The bristles may be natural or synthetic. For example, the bristles may be selected from bristles of polyethylene, of polypropylene, of ethylene/propylene copolymer, of polyamide (e.g., 6-6, 6-10, 6-11, or 6-12 polyamide), of polyester, of polyvinyl chloride, of polytetrafluoroethylene (e.g., TEFLON), of polyethylene terephthalate, or of thermoplastic elastomer.

The support may be made of, for example, polyethylene, polypropylene, or an elastomer.

It is possible to use bristles presenting a variety of cross-sections.

Figure 19:
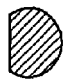
FIGS. 19 to 36 are diagrammatic cross-section views of different examples of bristles that may be used, amongst others.
Figure 20:
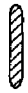
Figure 21:
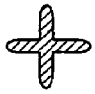
Figure 22:
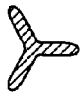
Figure 23:
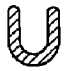
Figure 24:
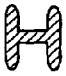
Figure 25:
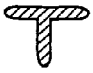
Figure 26:
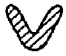
Figure 27:
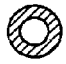
Figure 28:
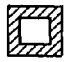
Figure 29:
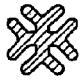
Figure 30:
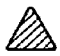
Figure 31:
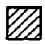
Figure 32:
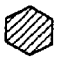
Figure 33:
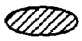
Figure 34:
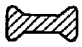

For example, it is possible to use bristles presenting a cross-section having one of the shapes shown in FIGS. 19 to 36 in a diagrammatic manner, for example a circular shape with a flat side as shown in FIG. 19, flattened as shown in FIG. 20, star-shaped (e.g. in the form of a cross as shown in FIG. 21 or having three branches as shown in FIG. 22), U-shaped as shown in FIG. 23, H-shaped as shown in FIG. 24, T-shaped as shown in FIG. 25, or V-shaped as shown in FIG. 26. The bristles may be hollow, e.g. being circular in shape as shown in FIG. 27, or prismatic, e.g., of square section as shown in FIG. 28. The bristles may form ramifications, for example being snowflake-shaped as shown in FIG. 29. The bristles may be prismatic in section, e.g. triangular, as shown in FIG. 30, square as shown in FIG. 31, hexagonal as shown in FIG. 32, or oblong, e.g., lenticular as shown in FIG. 33 or hourglass-shaped as shown in FIG. 34.

Figure 35:
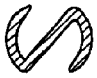

It is also possible to use bristles having portions that are hinged relative to one another, as shown in FIG. 35.

Figure 36:
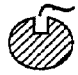

It is also possible to use bristles presenting at least one capillary groove 65, as shown in FIG. 36.

Figure 37:
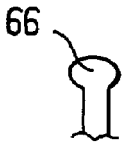
FIGS. 37 to 40 show various examples of structures and surface states that may be used for the bristles.
Figure 38:
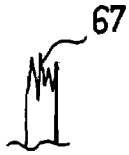

The bristles used may optionally be treated. For example, the bristles may be subjected to treatment for forming balls 66 at their ends as shown in FIG. 37 or forks 67 as shown in FIG. 38.

Figure 39:
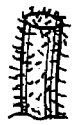
Figure 40:
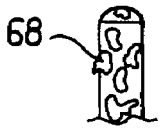

It is possible to use bristles that are flocked as shown in FIG. 39 or bristles made by extruding a plastic material containing a fill of particles 68, for example in order to confer microreliefs to the surface of the bristle as shown in FIG. 40, or to confer magnetic, bacteriostatic, improved sliding, or other properties thereto.

Figure 42:
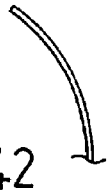
FIG. 42 shows a bristle that has been curved while hot.
Figure 41:
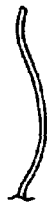
FIG. 41 shows an undulating bristle.

The bristles may also be undulating bristles as shown in FIG. 41 or they may be bristles that have been subjected to heat treatment in order to give them a curved shape, as shown in FIG. 42.

The bristles of an applicator element 5 need not all be of the same kind nor of the same length.

In some examples, bristles may have a cross-section that may be inscribed in a circle of diameter lying in the range about $6/100^{ths}$ of a millimeter to about $30/100^{ths}$ of a millimeter, e.g. in the range $8/100^{ths}$ of a millimeter to $20/100^{ths}$ of a millimeter.

The apparent length of the bristles, i.e. the length extending between the surface of the support 15 and the free end of the bristles, may lie in the range about 0.5 mm to about 20 mm, e.g., in the range 1 mm to 10 mm.

Throughout the description, including the claims, the expression "a" should be understood as being synonymous with "at least one" (i.e., relating to both the singular and the plural) unless otherwise specified to the contrary.

It will be apparent to those skilled in the art that various modifications and variations can be made to the structure described herein. Thus, it should be understood that the invention is not limited to the subject matter discussed in the specification. Rather, the present invention is intended to cover modifications and variations.

What is claimed is:

1. An applicator for applying a cosmetic product, the applicator comprising: an applicator element, wherein the applicator element comprises a support comprised of plastic material; and at least one bundle of bristles associated with the support, the bundle comprising an end portion defining a first row of bristles extending substantially in a longitudinal direction of the support, the bundle being split into at least two sub-bundles extending away from the end portion, the at least two sub-bundles defining second and third rows of bristles extending at least in part outside of the support, wherein the first row of bristles extends at least in part outside of the support.

2. An applicator according to claim 1, wherein the first row of bristles comprises a number of bristles that is substantially equal to a total number of bristles in the second and third rows.

3. An applicator according to claim 1, wherein the support defines distinct openings, and wherein the second and third rows of bristles comprise respective successions of tufts exiting the support via respective distinct openings.

4. An applicator according to claim 1, wherein the first row of bristles comprises a substantially continuous sheet of bristles.

5. An applicator according to claim 1, wherein the bundle of bristles is split to form the second and third rows inside the support.

6. An applicator according to claim 1, wherein the bundle of bristles is split to form the second and third rows outside the support.

7. An applicator according to claim 1, wherein the bristles are held to the support by overmolding the plastic material on the bristles.

8. An applicator according to claim 1, wherein the bristles are held to the support by local melting of the plastic material.

9. An applicator according to claim 1, wherein the support comprises at least one row of teeth.

10. An applicator according to claim 1, wherein a major dimension of the support in a plane perpendicular to a longitudinal axis of the support is less than or equal to 5 mm.

11. An applicator according to claim 1, wherein the second and third rows each comprise tufts of bristles, and wherein the tufts of the second row and the tufts of the third row are disposed at substantially the same level along an axis of the support.

12. An applicator according to claim 1, wherein the second and third rows each comprise tufts of bristles, and wherein the tufts of the second row are axially offset relative to the tufts of the third row.

13. An applicator according to claim 1, wherein the support defines openings situated respectively in two opposite faces of the support, and wherein the sub-bundles each define at least one tuft of bristles exiting the support via a respective one of the openings.

14. An applicator according to claim 1, wherein the support defines openings situated respectively in the same face of the support, and wherein the sub-bundles each define at least one tuft of bristles exiting the support via a respective one of the openings.

15. An applicator according to claim 1, wherein the support has a rectilinear longitudinal axis.

16. An applicator according to claim 1, wherein the support has a curvilinear longitudinal axis.

17. An applicator according to claim 1, wherein an apparent length of the bristles of at least one of the rows varies along a longitudinal axis of the support.

18. An applicator according to claim 1, wherein the support defines openings comprising axes perpendicular to a longitudinal axis of the support, and wherein the bristles pass through the openings and extend away from the support.

19. An applicator according to claim 1, wherein the support defines openings comprising axes directed obliquely relative to a longitudinal axis of the support, and wherein the bristles pass through the openings and extend away from the support.

20. An applicator according to claim 1, wherein the plastic material is at least one of a rigid material, a semi-rigid material, and an elastomer.

21. An applicator according to claim 1, further comprising a stem and a cap for closing a receptacle, the applicator element being located at one end of the stem and the cap being located at another end of the stem.

22. An applicator according to claim 21, wherein the support is fitted to the stem.

23. An applicator according to claim 21, wherein the support and the stem have an integral, one-piece construction.

24. An applicator according to claim 1, wherein the applicator is configured to apply the product to at least one of eyelashes and eyebrows.

25. An applicator according to claim 1, wherein the at least one bundle of bristles comprises a plurality of bundles of bristles, and wherein each of the bundles is split into at least two sub-bundles.

26. An applicator according to claim 25, wherein the support defines a plurality of openings, wherein bristles of the sub-bundles pass through the openings and extend away from the support.

27. An application device comprising:

an applicator according to claim 1; and a cosmetic product to be applied via the applicator.

28. An application device according to claim 27, wherein the cosmetic product is a cosmetic product for application to at least one of the eyelashes and eyebrows.

29. An application device comprising:

an applicator according to claim 1; and a receptacle configured to contain the cosmetic product.

30. An application device of claim 29, further comprising a wiper associated with the receptacle, the wiper being configured to wipe the applicator.

31. An applicator for applying a cosmetic product, the applicator comprising: an applicator element, wherein the applicator element comprises a support comprised of plastic material; and at least one bundle of bristles associated with the support, the bundle comprising an end portion defining a first row of bristles extending substantially in a longitudinal direction of the support, the bundle being split into at least two sub-bundles extending away from the end portion, the at least two sub-bundles defining second and third rows of bristles extending at least in part outside of the support, wherein the second and third rows of bristles extend from one side of the support relative to a separation plane containing a longitudinal axis of the support, and wherein the first row extends from an opposite side of the support relative to the separation plane.

32. An applicator for applying a cosmetic product, the applicator comprising: an applicator element, wherein the applicator element comprises a support comprised of plastic material; and at least one bundle of bristles associated with the support, the bundle comprising an end portion defining a first row of bristles extending substantially in a longitudinal direction of the support, the bundle being split into at least two sub-bundles extending away from the end portion, the at least two sub-bundles defining second and third rows of bristles extending at least in part outside of the support, wherein the support comprises at least one row of teeth and wherein the row of teeth extends between the second and third rows of bristles.

33. An applicator for applying a cosmetic product, the applicator comprising:

an applicator element, wherein the applicator element comprises a support comprised of plastic material, wherein the support defines a plurality of openings; and at least one bundle of bristles associated with the support, the bundle being split into at least a first sub-bundle comprising bristles passing through at least one of the openings and extending away from the support, and a second sub-bundle comprising bristles passing through at least one other of the openings and extending away from the support, wherein the first sub-bundle and the second sub-bundle extend away from an end portion of the bundle, wherein the end portion of the bundle extends at least in part outside of the support.

34. An applicator according to claim 33, wherein the end portion defines a row of bristles extending substantially in a longitudinal direction of the support.

35. An applicator according to claim 33, the first and second sub-bundles each define a respective row of bristles extending at least in part outside of the support.

36. An applicator according to claim 33, wherein the end portion comprises a number of bristles that is substantially equal to a total number of bristles in the first and second sub-bundles.

37. An applicator according to claim 33, wherein the first and second sub-bundles comprise respective successions of tufts exiting the support via the openings.

38. An applicator according to claim 33, wherein the end portion comprises a substantially continuous sheet of bristles.

39. An applicator according to claim 33, wherein the bundle of bristles is split to form the first and second sub-bundles inside the support.

40. An applicator according to claim 33, wherein the bundle of bristles is split to form the first and second sub-bundles outside the support.

41. An applicator according to claim 33, wherein the bristles are held to the support by overmolding the plastic material on the bristles.

42. An applicator according to claim 33, wherein the bristles are held to the support by local melting of the plastic material.

43. An applicator according to claim 33, wherein the support comprises at least one row of teeth.

44. An applicator according to claim 33, wherein a major dimension of the support in a plane perpendicular to a longitudinal axis of the support is less than or equal to 5 mm.

45. An applicator according to claim 33, wherein the first and second sub-bundles each comprise a tuft of bristles.

46. An applicator according to claim 45, wherein the tufts are disposed at substantially the same level along an axis of the support.

47. An applicator according to claim 45, wherein the tufts are axially offset relative to each other.

48. An applicator according to claim 33, wherein the openings are situated respectively in the same face of the support.

49. An applicator according to claim 33, wherein the support has a rectilinear longitudinal axis.

50. An applicator according to claim 33, wherein the support has a curvilinear longitudinal axis.

51. An applicator according to claim 33, wherein an apparent length of the bristles of at least one of the sub-bundles varies along a longitudinal axis of the support.

52. An applicator according to claim 33, wherein the openings comprise axes perpendicular to a longitudinal axis of the support.

53. An applicator according to claim 33, wherein the openings comprise axes directed obliquely relative to a longitudinal axis of the support.

54. An applicator according to claim 33, wherein the plastic material is at least one of a rigid material, a semi-rigid material, and an elastomer.

55. An applicator according to claim 33, further comprising a stem and a cap for closing a receptacle, the applicator element being located at one end of the stem and the cap being located at another end of the stem.

56. An applicator according to claim 55, wherein the support is fitted to the stem.

57. An applicator according to claim 55, wherein the support and the stem have an integral, one-piece construction.

58. An applicator according to claim 33, wherein the applicator is configured to apply the product to at least one of eyelashes and eyebrows.

59. An applicator according to claim 33, wherein the at least one bundle of bristles comprises a plurality of bundles of bristles, and wherein each of the bundles is split into at least two sub-bundles.

60. An applicator according to claim 59, wherein bristles of each of the sub-bundles pass through a respective one of the openings and extend away from the support.

61. An application device comprising:

an applicator according to claim 33; and a cosmetic product to be applied via the applicator.

62. An application device according to claim 61, wherein the cosmetic product is a cosmetic product for application to at least one of the eyelashes and eyebrows.

63. An application device comprising:

an applicator according to claim 33; and a receptacle configured to contain the cosmetic product.

64. An application device of claim 63, further comprising a wiper associated with the receptacle, the wiper being configured to wipe the applicator.

65. An applicator for applying a cosmetic product, the applicator comprising:

an applicator element, wherein the applicator element comprises a support comprised of plastic material, wherein the support defines a plurality of openings; and at least one bundle of bristles associated with the support, the bundle being split into at least a first sub-bundle comprising bristles passing through at least one of the openings and extending away from the support, and a second sub-bundle comprising bristles passing through at least one other of the openings and extending away from the support, wherein the first sub-bundle and the second sub-bundle extend away from an end portion of the bundle, wherein the first and second sub-bundles extend from one side of the support relative to a separation plane containing a longitudinal axis of the support, and wherein the end portion extends from an opposite side of the support relative to the separation plane.

66. An applicator for applying a cosmetic product, the applicator comprising:

an applicator element, wherein the applicator element comprises a support comprised of plastic material, wherein the support defines a plurality of openings; and at least one bundle of bristles associated with the support, the bundle being split into at least a first sub-bundle comprising bristles passing through at least one of the openings and extending away from the support, and a second sub-bundle comprising bristles passing through at least one other of the openings and extending away from the support, wherein the first sub-bundle and the second sub-bundle extend away from an end portion of the bundle, wherein the openings are situated respectively in two opposite faces of the support.

* * * * *

UNITED STATES PATENT AND TRADEMARK OFFICE

CERTIFICATE OF CORRECTION

PATENT NO. : 7,886,397 B2
APPLICATION NO. : 10/790179
DATED : February 15, 2011
INVENTOR(S) : Jean-Louis H. Gueret It is certified that error appears in the above-identified patent and that said Letters Patent is hereby corrected as shown below:

Title page, item 57 (abstract), line 6, "may being split" should read -- may be split --.

Signed and Sealed this
Twenty-first Day of June, 2011

David J. Kappos

David J. Kappos
*Director of the United States Patent and Trademark Office*